US005735616A

United States Patent [19]

Sugiura

[11] Patent Number: 5,735,616

[45] Date of Patent: Apr. 7, 1998

[54] PRINTING MECHANISM WITH MEANS FOR PREVENTING CONTACT BETWEEN INK RIBBON AND DRIVE IC OF THERMAL HEAD

[75] Inventor: Toshio Sugiura, Anjo, Japan

[73] Assignee: Brother Kogyo Kabushiki Kaisha, Nagoya, Japan

[21] Appl. No.: 675,003

[22] Filed: Jul. 3, 1996

[30] Foreign Application Priority Data

Jul. 14, 1995 [JP] Japan ..... 7-178827

[51] Int. Cl.[6] ..... B41J 2/315

[52] U.S. Cl. ..... 400/120.01; 400/248

[58] Field of Search ..... 400/120.01, 248, 400/120.09, 120.16, 642; 347/200, 201

[56] References Cited

U.S. PATENT DOCUMENTS 5,317,341 5/1994 Tatsumi ..... 346/76 PH
5,499,880 3/1996 Pickering et al. ..... 400/462
5,570,123 10/1996 Almonte ..... 347/200

FOREIGN PATENT DOCUMENTS 363 270176A 11/1988 Japan ..... 400/462
402 281967A 11/1990 Japan ..... 400/248

*Primary Examiner*—Edgar S. Burr
*Assistant Examiner*—Dave A. Ghatt
*Attorney, Agent, or Firm*—Oliff & Berridge

[57] ABSTRACT

A printing mechanism for recording images on a recording medium using an ink ribbon urged to follow a transport path, including a thermal head; a drive IC for driving the thermal head, at least a portion of the drive IC being disposed in the transport path; and an ink ribbon protection film disposed between the drive IC and the ink ribbon and for preventing the drive IC and the ink ribbon from contacting each other.

21 Claims, 3 Drawing Sheets

PRINTING MECHANISM WITH MEANS FOR PREVENTING CONTACT BETWEEN INK RIBBON AND DRIVE IC OF THERMAL HEAD

BACKGROUND OF THE INVENTION

1. Field of the Invention

The present invention relates to a printing device including a thermal head for recording images on a recording medium using an ink ribbon.

2. Description of the Related Art

A conventional printer mechanism shown in FIG. 1. The printing mechanism includes a sheet-supply portion 1 and a recording portion 15. The sheet supply-portion 1 includes a paper cassette 2 and a sheet feed roller 4. The paper cassette 2 houses a stack of a plurality of print sheets 3. The sheet feed roller 4 separates the upper most print sheet 3 from the other print sheets 3 housed in the paper cassette 2 and transports it out of the paper cassette 2.

As shown in FIG. 1, a pair of feed rollers 5 are rotatably disposed between the sheet-supply portion 1 and the recording portion 15. The pair of feed rollers 5 are for transporting to the recording portion 15 print sheets 3 transported from the sheet-supply portion 1.

The recording portion 15 includes a thermal head 6, an ink ribbon 7, and a rotatable cylindrical platen 8 positioned below the thermal head 6. Although not shown in the drawings, a plurality of thermal elements θ are disposed at a printing position at one edge, that is the left edge when viewed in the drawings, of the thermal head 6. The thermal head 6 is movable between a recording position wherein the thermal elements θ are brought into abutment with the platen 8, and a recessed position, wherein the thermal elements θ are separated away from the platen 8. A spring 9 presses the thermal elements θ of the thermal head 6 against the platen 8 when the thermal head 6 is in its recording position. The ink ribbon 7 is formed by coating a film shaped substrate with ink on one side. The print sheet 3 and the ink ribbon 7 are sandwiched between the platen 8 and the thermal head 6 and are transported in association with rotation of the platen 8.

When the thermal elements θ of the thermal head 6 are selectively energized, the ink on the ink ribbon 7 melts and is transferred to the surface of the print sheet 3, thereby recording an image. The print sheet 3 with a recorded image formed thereon is supplied by a pair of discharge rollers 10 and further transported thereby until discharged from the printing device.

The ink ribbon 7 is suspended between a supply portion **7*a* and a take-up portion 7*b* and applied with an appropriate amount of tension. Although not shown in the drawings, the supply portion 7*a* is supported on a supply spool. The unused portion of the ink ribbon is wrapped around the supply portion 7*a*, and the portion of -the ink ribbon used during recording is drawn away from the supply portion 7*a* and wrapped up on the take-up portion 7*b***.

A frame 11 is disposed above the thermal head 6. The frame 11 includes at its lower edge a pair of guide portions **11*a*, 11*b*, which sandwich the recording portion 15. The ink ribbon 7 is suspended between the supply portion 7*a* and the take-up portion 7*b* so as to run substantially perpendicular to lower edges of the frame 11. The portion of the ink ribbon between the supply portion 7*a* and the take-up portion 7*b* is guided pressed downward by the pair of guide portions 11*a*, 11*b***.

A drive IC **6*b* for selectively energizing the thermal elements θ is mounted to the edge of the thermal head 6** opposite the edge on which the thermal elements θ are mounted.

However, as shown in FIG. 2, a portion of the print sheet 3 directly before the printing position bends upward, thereby pressing against the unused portion of the ink ribbon. The ink ribbon is pushed upward into abutment with a corner portion P of the drive IC **6*b* mounted on the thermal head 6**.

Because the surface of the drive IC **6*b* is rough, and because the corner portion P is formed into a substantially right angle, the ink coating the unused portion of the ink ribbon is scraped off onto the print sheet 3, thereby staining the surface of the print sheet 3**.

Also when dust and other undesirable material exist on the surface of the ink ribbon 7, because the surface of the drive IC **6*b* is rough, the dust and the like can be collect on the corner portion P. The ink ribbon 7 can scrape against the print sheet 3 and be damaged by the dust on the corner portion P when the ink ribbon 7 scrapes against the print sheet 3. Also, the print sheet 3** can be stained.

Further, the ink ribbon itself can be damaged so that the recording processes are impaired.

One possible solution to the above described problems would be to separate the drive IC **6*b* and the ink ribbon 7 with a greater distance. However, this would increase the size of the thermal head 6** and increase costs as well. Further, the printing device itself would have to be made larger.

SUMMARY OF THE INVENTION

It is an objective of the present invention to overcome the above described problems and to provide a printing mechanism capable of transporting an ink ribbon without damaging it.

To achieve the above-described objectives, a printing mechanism according to the present invention is for recording images on a recording medium using an ink ribbon urged to follow a transport path and includes a thermal head; a drive IC for driving the thermal head, at least a portion of the drive IC being disposed in the transport path; and an ink ribbon protection means disposed between the drive IC and the ink ribbon and for preventing the drive IC and the ink ribbon from contacting each other.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
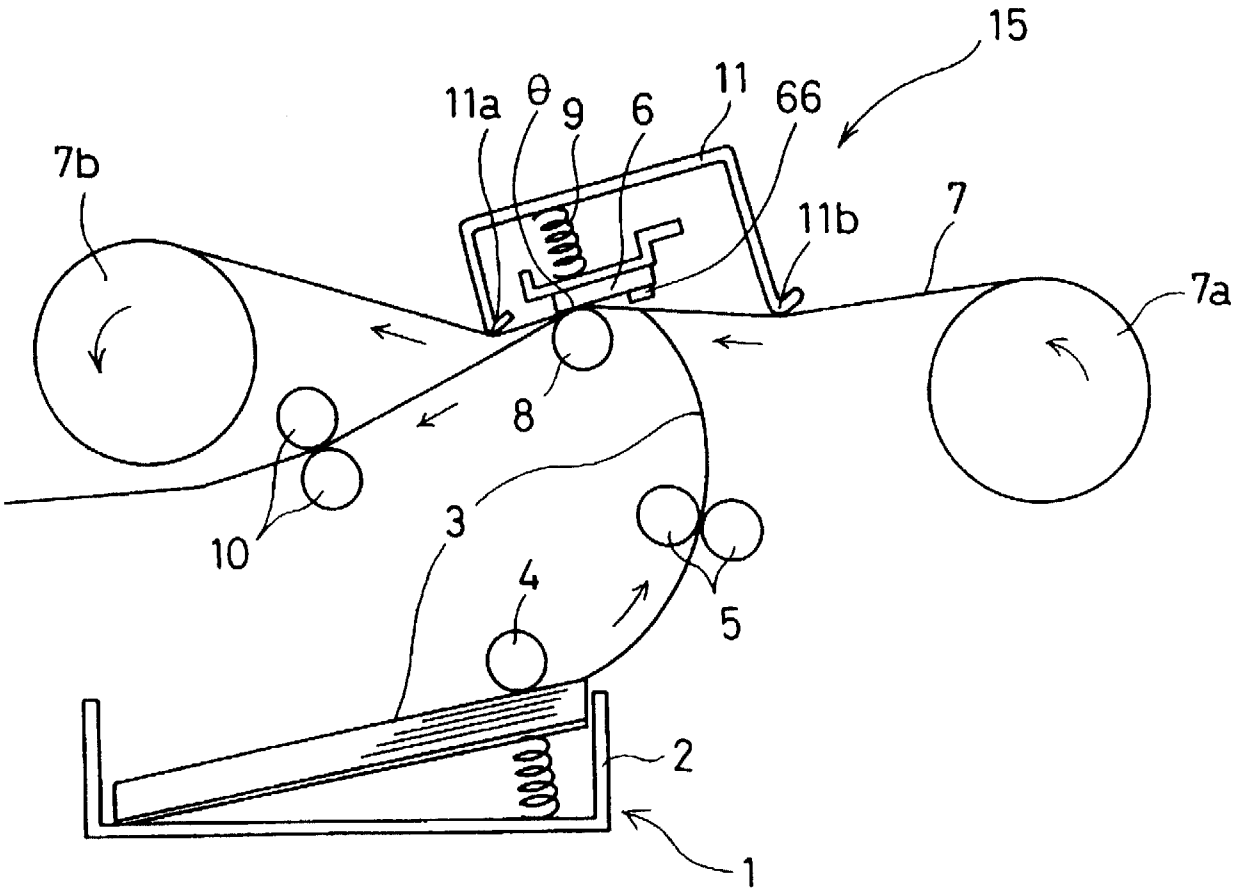
FIG. 1 PRIOR ART
FIG. 1 is a side view showing a conventional printing mechanism.
Figure 2:
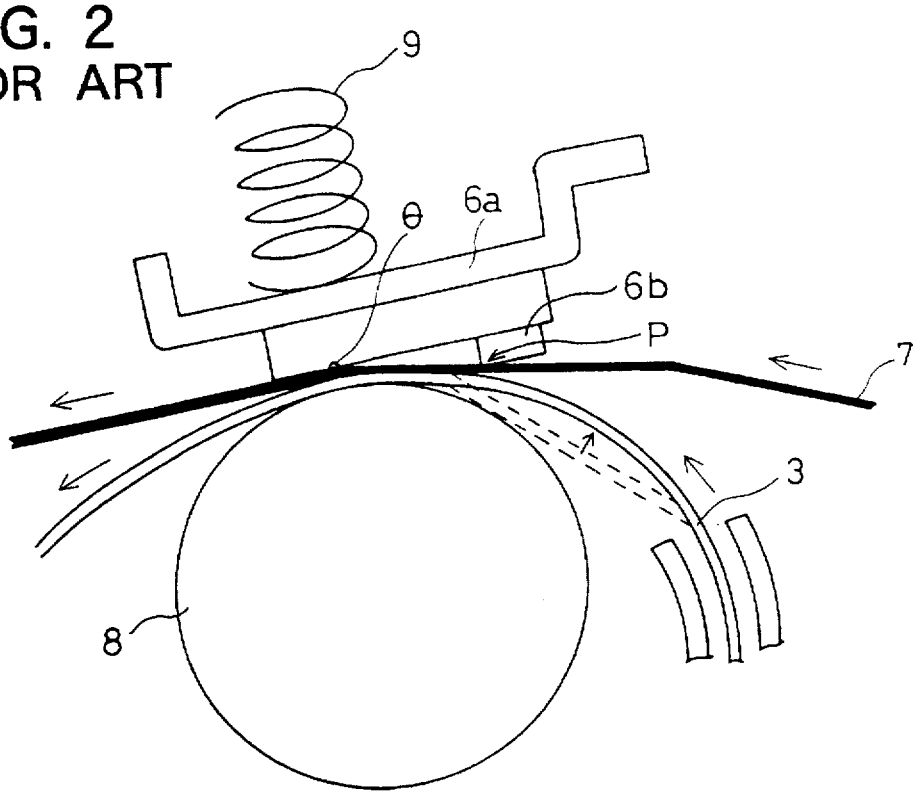
FIG. 2 PRIOR ART
FIG. 2 is a magnified side view showing the printing mechanism of FIG. 1.

A printing mechanism according to a preferred embodiment of the present invention will be described while referring to the accompanying drawings wherein like parts and components are designated by the same reference numerals to avoid duplicating description.

Figure 3:
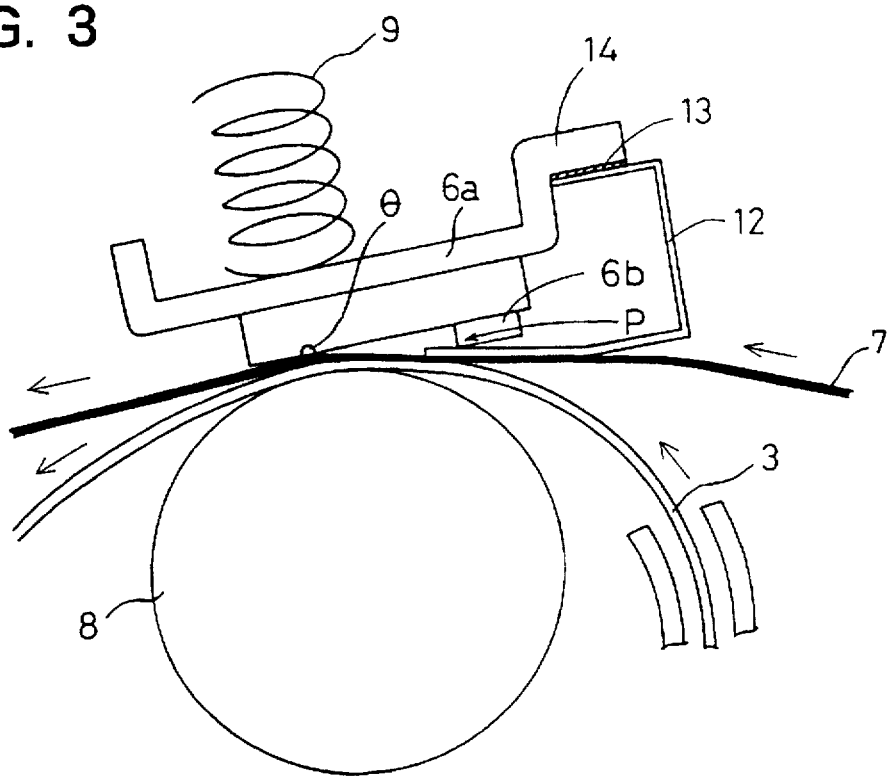
FIG. 3 is a side view showing a printing mechanism according to an embodiment of the present invention.
Figure 4:
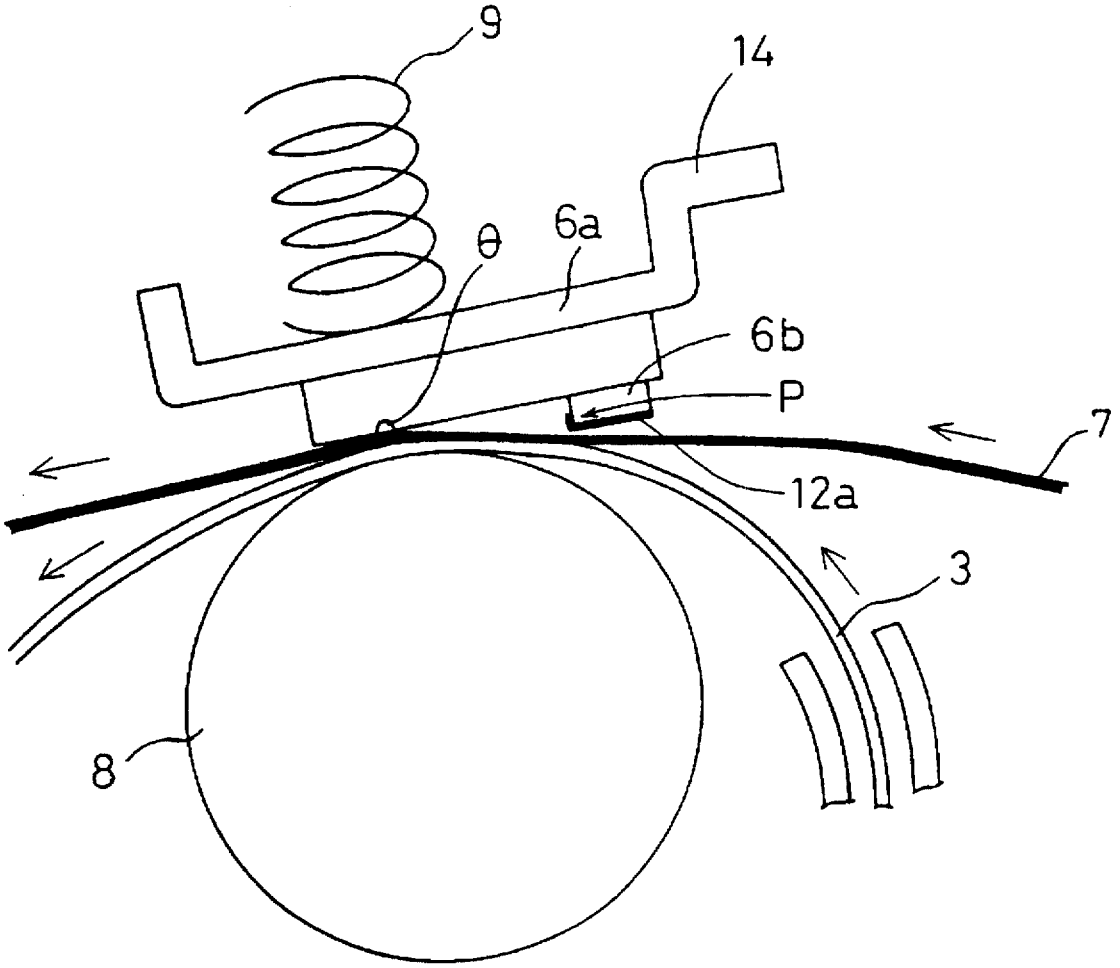
FIG. 4 is a side elevation view of the printing mechanism showing an alternative embodiment of the invention.

FIG. 3 shows the central portion of a printing mechanism according to the present embodiment. A thermal head 6 is mounted in the printing mechanism. A plurality of thermal elements θ are juxtaposed along one edge at the surface of the thermal head 6. An IC mold portion **6*b* serving as a drive IC is disposed at an edge of the thermal head 6** opposite the edge to which the thermal elements θ are provided.

A metal thermal discharge plate 14 for discharging heat generated during recording is attached to the rear surface of the thermal head 6, i.e., to the surface opposite the surface provided with the thermal elements θ and the IC mold portion **6*b*. Further, a spring 9 for pressing the thermal discharge plate 14 downward is in abutment with the rear surface of the thermal discharge plate 14**.

One end of an approximately C-shaped ink ribbon protection film 12 is fixed to the side of the thermal discharge plate 14 by a two sided tape 13. The other end of the ink ribbon protection film 12 covers the lower surface of the IC mold portion **6*b* and is unattached and able to bend freely. The ink ribbon protection film 12 therefore serves as an ink ribbon protection member formed so as to cover the lower surface of the IC mold portion 6*b***.

Described in more detail, the ink ribbon protection film 12 is formed in an approximate C shape in cross section from a resin, such as polyvinyl chloride (PVC), or a polyester, such as polyethylene terephthalate (PET). The ink ribbon protection film 12 has a surface roughness smooth enough to prevent collection of dust and other undesirable material. The tip of the ink ribbon protection film 12 not attached by the two-sided tape 13 to the thermal discharge plate 14 extends beyond the position of the IC mold portion **6*b*, thereby covering the IC mold portion 6*b***.

Although not shown in the drawings, the ink ribbon 7 is suspended between two spools of a ribbon feed mechanism that urges the ink ribbon 7 to follow a transport path by placing tension on and driving the ink ribbon 7. The end of the ink ribbon protection film 12 covering the drive IC **6*b* also serves as a guide means for guiding the ink ribbon 7** along the transport path.

A corner portion P of the drive IC **6*b* protrudes into the transport path of the ink ribbon 7 and so without the ink ribbon protection film 12 would contact the ink ribbon 7. The ink ribbon protection film 12 configured in this manner guides the ink ribbon 7 to the record position without allowing contact between the ink ribbon 7 and the IC mold portion 6*b*. Therefore, the ink ribbon 7 is unaffected by the shape of the corner portion P are the surface of the IC mold portion 6*b*. The IC mold portion 6*b*** can be formed more freely, that is, with an angled corner portion P or a rough surface if necessary.

While the invention has been described in detail with reference to specific embodiments thereof, it would be apparent to those skilled in the art that various changes and modifications may be made therein without departing from the spirit of the invention, the scope of which is defined by the attached claims.

For example, although it was described in the embodiment that the ink ribbon protection film 12 serves as an ink ribbon protection means, instead the IC mold portion **6*b* itself could be coated with a material 12*a* which smooth-surfaced material having good sliding characteristics. Alternatively, a tape 12*a* with a smooth surface with a good sliding characteristics could be adhered to the surface of the IC mold portion 6*b*. Alternatively, a smooth-surfaced metal member 12*a*** could also serve as the ink ribbon protection means. Further, any of these ink ribbon protection means could be used for preventing contact between the ink ribbon and other members besides a drive IC. That is, an ink ribbon protection means could be disposed between the ink ribbon and a member such as a sensor or other member required for operation of the printer, and could prevent the member and the ink ribbon from contacting each other.

The ink ribbon will not contact the drive IC in a printing mechanism according to present invention. Therefore, the unused portion of the ink ribbon can be transported without receiving any damage. As a result, the ink on the surface of the ink ribbon will not be peeled off by contact with the drive IC. Further, the ink will not inadvertently become attached to the recording medium. Therefore, the surface of the recording medium will not be stained.

In a printing mechanism according another aspect of the present invention, an ink ribbon protection means covers at least a portion of the drive IC, which would otherwise contact the ink ribbon. Such an ink ribbon protection means is easier to produce and assemble, and its configuration is simpler than an ink protection means that covers the ink ribbon itself.

According to still another aspect of the present invention, the ink ribbon protection means is configured from a film shaped member. Therefore, the ink ribbon protection member is easy to form. Also, it will not apply a large force on the ink ribbon or on the recording medium itself, and so will not damage either of these.

According to a further aspect of the present invention, the ink ribbon protection means is mounted on a thermal discharge member which is for discharging heat and which is attached to the thermal head. Therefore, such an ink ribbon protection means will be less likely to undergo hear deformation or heat damage than would an ink ribbon protection means attached directly to the thermal head.

What is claimed is:

1. A printing mechanism for recording images on a recording medium using an ink ribbon urged to follow a transport path, comprising:

a thermal head;

a drive IC for driving the thermal head; and an ink ribbon protection means disposed between the drive IC and the ink ribbon, said protection means being made from a flexible polymer material having sufficient flexibility to bend in response to contact with the ink ribbon and for preventing the drive IC and the ink ribbon from contacting each other.

2. A printing mechanism as claimed in claim 1, wherein the ink ribbon protection means is formed so as to cover a portion of the drive IC.

3. A printing mechanism as claimed in claim 2, wherein the ink ribbon protection means is formed from a flexible sheet.

4. A printing mechanism as claimed in claim 3, wherein the thermal head is mounted on a thermal discharge member for discharging heat from the thermal head and the ink ribbon protection means is mounted to the thermal discharge member.

5. A printing mechanism as claimed in claim 4, wherein the ink ribbon protection means includes a C-shaped member with one end adhered to the thermal discharge member and an opposite end covering the portion of the drive IC.

6. A printing mechanism as claimed in claim 5, wherein the opposite end is unattached and able to bend freely.

7. A printing mechanism as claimed in claim 5, wherein the opposite end serves as a guide means for guiding the ink ribbon along the transport path.

8. A printing mechanism as claimed in claim 1, wherein the ink ribbon, protection means is formed from a flexible sheet.

9. A printing mechanism as claimed in claim 8, wherein the thermal head is mounted on a thermal discharge member for discharging heat from the thermal head and the ink ribbon protection means is mounted to the thermal discharge member.

10. A printing mechanism as claimed in claim 3, wherein the ink ribbon protection means includes a C-shaped member with one end fixed in place and an opposite end covering the portion of the drive IC.

11. A printing mechanism as claimed in claim 10, wherein the opposite end is unattached and able to bend freely.

12. A printing mechanism as claimed in claim 10, wherein the opposite end serves as a guide means for guiding the ink ribbon along the transport path.

13. A printing mechanism as claimed in claim 1, wherein the thermal head is mounted on a thermal discharge member for discharging heat from the thermal head and the ink ribbon protection means is mounted to the thermal discharge member.

14. A printing mechanism as claimed in claim 13, wherein the ink ribbon protection means includes a C-shaped member with one end adhered to the thermal discharge member and an opposite end covering the portion of the drive IC.

15. A printing mechanism for recording images on a recording medium using an ink ribbon urged to follow a transport path, comprising:

a thermal head;

a member; and an ink ribbon protection means disposed between the member and the ink ribbon, said protection means being made from a flexible polymer material having sufficient flexibility to bend in response to contact with the ink ribbon and for preventing the member and the ink ribbon from contacting each other.

16. A printing mechanism as claimed in claim 15, wherein the ink ribbon protection means is formed so as to cover a portion of the member.

17. A printing mechanism as claimed in claim 16, wherein the ink ribbon protection means is formed from a flexible sheet.

18. A printing mechanism as claimed in claim 17, wherein the thermal head is mounted on a thermal discharge member for discharging heat from the thermal head and the ink ribbon protection means is mounted to the thermal discharge member.

19. A printing mechanism as claimed in claim 18, wherein the ink ribbon protection means includes a C-shaped member with one end adhered to the thermal discharge member and an opposite end covering the portion of the member.

20. A printing mechanism as claimed in claim 19, wherein the opposite end is unattached and able to bend freely.

21. A printing mechanism as claimed in claim 20, wherein the opposite end serves as a guide means for guiding the ink ribbon along the transport path.

* * * * *